United States Patent [19]

Colby

[11] Patent Number: 4,570,547

[45] Date of Patent: Feb. 18, 1986

[54] TABLE WITH ADJUSTABLE HEIGHT MECHANISM

[76] Inventor: Edward Colby, 214 St. Sacrement St., Montreal (Quebec), Canada, H2Y 1W8

[21] Appl. No.: 583,845

[22] Filed: Feb. 27, 1984

[30] Foreign Application Priority Data

Mar. 4, 1983 [CA] Canada ..... 422867

[51] Int. Cl.[4] ..... A47B 9/04; A47B 11/00

[52] U.S. Cl. ..... 108/141; 108/147; 248/188.4

[58] Field of Search ..... 108/144, 147, 20, 22, 108/94, 95, 105, 141; 248/157, 425, 188.2, 188.4

[56] References Cited

U.S. PATENT DOCUMENTS

| | | | |
|---|---|---|---|
| 490,286 | 1/1893 | Hollowell | 108/95 |
| 586,408 | 7/1897 | Williams | 108/147 |
| 729,642 | 6/1903 | Nash | 108/94 |
| 758,431 | 4/1904 | Edeline | 108/147 |
| 765,347 | 7/1904 | Vogel | 108/147 |
| 896,382 | 8/1908 | Hanson | 108/147 |
| 1,257,871 | 2/1918 | Jaquette | 108/20 |
| 1,483,749 | 2/1924 | Seear | 108/20 |
| 1,740,831 | 12/1929 | Patterson | 108/95 |
| 2,831,746 | 4/1958 | Hartnett | 108/147 |

FOREIGN PATENT DOCUMENTS

| | | | |
|---|---|---|---|
| 3125904 | 1/1983 | Fed. Rep. of Germany | 108/147 |

*Primary Examiner*—William E. Lyddane
*Assistant Examiner*—Mark W. Binder
*Attorney, Agent, or Firm*—Cushman, Darby & Cushman

[57] ABSTRACT

The disclosure herein describes a table with a top plate which may be lowered or raised by rotating it; the table includes a base support on which are mounted rotatable elements which use the rotation of the table to cause linear vertical displacement of threaded posts which engage these elements and on which rests the top plate; hence, vertical displacement of the table top simultaneously follows the vertical displacement of the posts.

6 Claims, 3 Drawing Figures

TABLE WITH ADJUSTABLE HEIGHT MECHANISM

FIELD OF THE INVENTION

The present invention relates to a table and, more particularly, to a type of table with an adjustable height mechanism that can be actuated by the user turning the top plate.

BACKGROUND OF THE INVENTION

The height of the table can be a major factor in changing the atmosphere, function and formality of a room. However, the weight and/or dimension of a table often render difficult lowering or raising a table top by one person only. On the other hand, the table being a decorative object in a room, the use of aiding mechanisms for lowering and raising its top plate such as mechanical means associated with an electrical or mechanical drive source is often not desired.

OBJECTS AND STATEMENT OF THE INVENTION

It is an object of the present invention to provide a height mechanism for a table which can be activated by the user simply by turning its top plate. Thus, rotating the table top and the resulting visual transformation of a room are thus combined in a single act created and observed by the user.

The present invention therefore relates to a table which comprises in its broadest aspect:

- a base support;
- vertically displaceable means mounted on the base support;
- first rotatable means mounted on the base support for causing the vertical displacement of the vertically displaceable means relative to the base support;
- second rotatable means mounted to the base support and engaging the first rotatable means to transfer rotation thereto;
- a drive shaft engaging the second rotatable means and being slidably mounted thereto;
- a top plate resting on the vertically displaceable means and supporting therebeneath the drive shaft whereby rotation of the top plate is transferred to the first rotatable means via the drive shaft and the second rotatable means to thereby simultaneously raise or lower the vertically displaceable means and the top plate.

In one form of the invention, the vertical displaceable means consist of a plurality of vertically extending threaded posts and an annular support plate disposed at the upper end of the post and receiving the top plate thereon.

Yet, in another form of the invention, the first and second rotatable means consist of a large wheel that engages a series of small toothed wheels, each threadedly engaging a vertical post.

The scope of applicability of the present invention will become apparent from the detailed description given hereinafter; it should be understood, however, that this description, while indicating preferred embodiments of the invention, is given by way of illustration only since various changes and modifications within the spirit and scope of the invention will become apparent to those skilled in the art.

DESCRIPTION OF PREFERRED EMBODIMENTS

Figure 1:
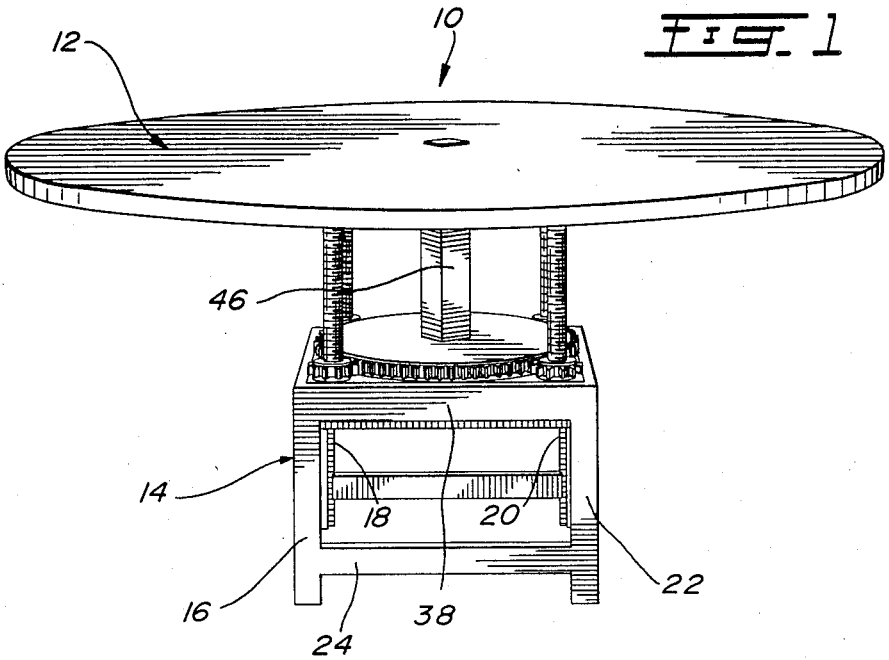
FIG. 1 is a perspective view of a table made in accordance with the present invention with the top plate in its upmost position.
Figure 2:
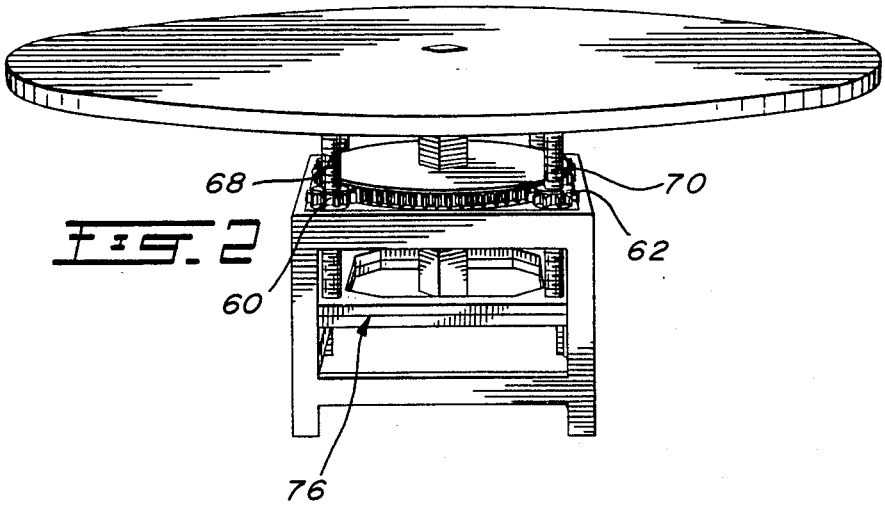
FIG. 2 is a perspective view showing the table top in an intermediate lowered position.
Figure 3:
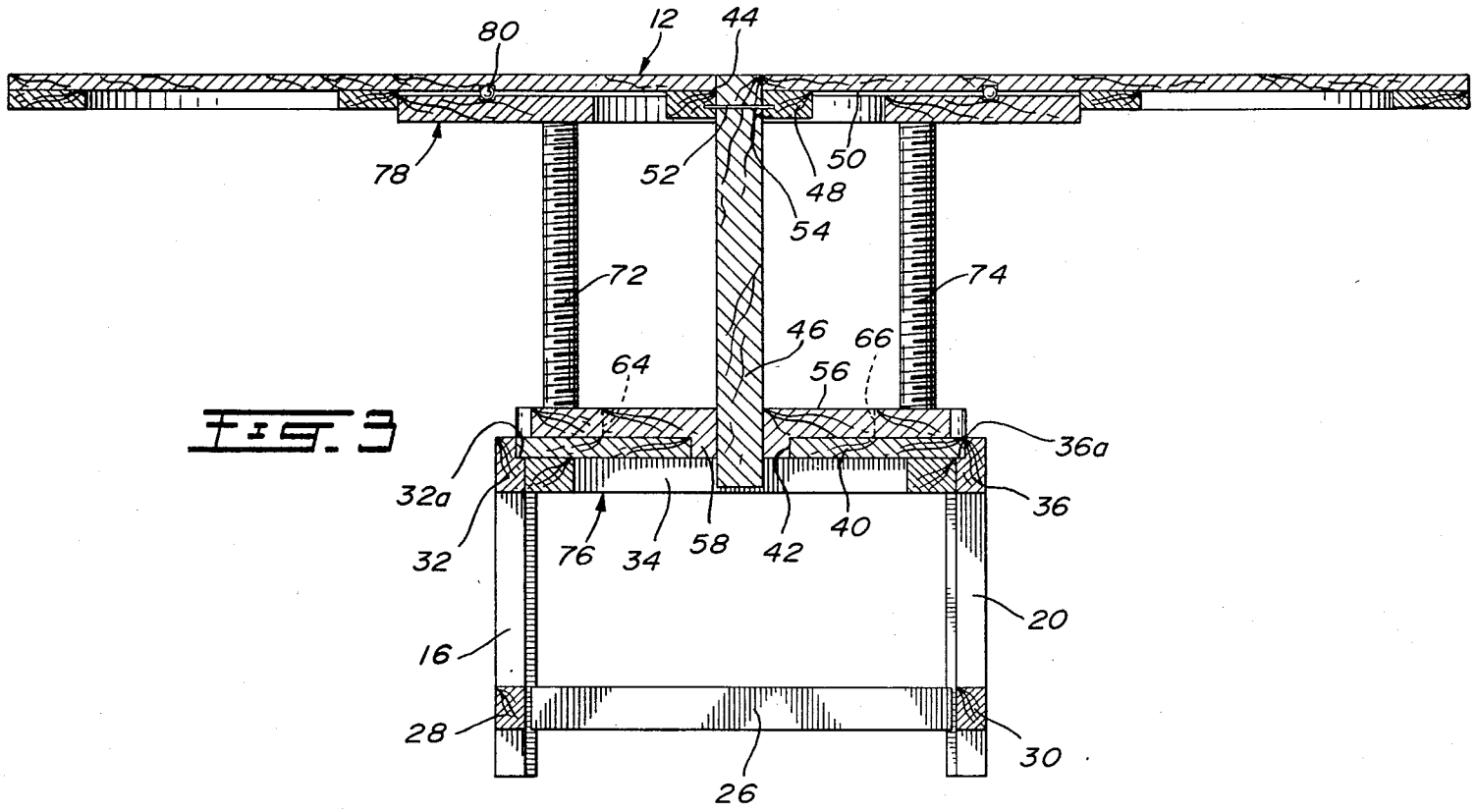
FIG. 3 is a cross-sectional elevation of the table made in accordance with the present invention.

Referring to FIGS. 1, 2 and 3, the table made in accordance with the present invention is generally denoted 10 and includes a top plate 12 which is shown circular but which may have various configurations. The table also includes a base support 14 including four legs 16, 18, 20 and 22 which are interconnected at their lower part by braces 24, 26, 28 and 30. The upper part of the base support includes a top frame consisting of four braces 32, 34, 36, 38, each having a shoulder (two of which are indicated as 32*a* and 36*a*) into which rests a horizontal plate 40 having a central opening 42.

The top plate 12 has a central opening 44 through which extends a drive shaft 46. The drive shaft suspends vertically underneath the top plate by its attachment to an annular member 48 fixedly attached to the underface 50 of the top plate; a pin 52 traverses drive shaft 46 with its opposed ends secured into the annular member 48. In the embodiment illustrated, the drive shaft has a square cross-section corresponding to the similarly shaped opening 44 in the top plate 12 and central opening 54 in the annular member 48.

A large sun gear or wheel 56, with a central opening of square cross-section receiving therein the lower part of the drive shaft 46, has a central hub 58 which extends between the drive shaft and the plate 40. The periphery of wheel 56 has a toothed configuration so that it may engage and drive a series of smaller planetary gears or toothed wheels 60, 62, 64, 66, mounted on plate 40, each wheel threadedly engaging a vertically displaceable threaded post 68, 70, 72, 74. The lower extremity of each post is fixedly engaged in a lower inner frame 76 which, in turn, is displaceable within the base support 14. The upper extremity of each vertical post is also fixedly engaged in an annular support plate 78 which is located underneath the top plate 12 and which serves to support the top plate in a manner to provide stability. As the annular plate 78 is fixed and the top plate 12 is rotatable, friction reducing means are provided between these two plates and may take the form of a ball-bearing arrangement 80 appropriately received in respective grooves provided in the upper face of plate 78 and in the underface 50 of top plate 12. Other friction reducing means may be used.

Operation of the table will be explained with reference to FIG. 3 where the top plate is in its upmost position. To lower the top plate, the user rotates the top plate 12 in one rotational direction. The rotational movement of the plate is transferred to the small toothed wheels via the drive shaft 46 and the large toothed wheel 56. This causes the vertical posts to be lowered and, simultaneously, the table top 12 which rests on the annular member 78 is also lowered.

Although the invention has been described above in relation to one specific form, it will be evident to the person skilled in the art, that it may be refined and modified in various ways. For example, the entire table is shown being made of wood; but, other materials could be used to form the table or parts thereof. It is therefore wished to have it understood that this invention should not be limited in interpretation except by the terms of the following claims.

The embodiments of the invention in which an exclusive property or privilege is claimed are defined as follows:

1. A table comprising:

a base support;

vertically displaceable means mounted on said base support;

said vertically displaceable means including a plurality of vertically extending threaded posts;

first rotatable means mounted on said base support threadably engaging said threaded posts for causing vertical displacement of said vertically displaceable means relative to said base support;

second rotatable means mounted to said base support and engaging said first rotatable means to transfer rotation thereto;

a drive shaft engaging said second rotatable means, said shaft being slidably mounted relative to said second rotatable means;

a top plate resting on said vertically displaceable means, an annular support frame disposed at the upper extremity of said threaded posts; said support frame receiving said top plate thereon; said top plate being fixedly mounted on said drive shaft whereby rotation of said top plate is transferred to said first rotatable means via said drive shaft and said second rotatable means to thereby simultaneously raise or lower said vertically displaceable means and said top plate.

2. A table as defined in claim 1, further comprising friction reducing means between said top frame and said annular support plate.

3. A table as defined in claim 1, wherein said first rotatable means consist of a plurality of planetary toothed gears, each gear threadly engaging one of said posts and wherein said second rotatable means consist of a toothed sun gear having a diameter such that the toothed periphery thereof engages the toothed planetary gears.

4. A table as defined in claim 3, wherein said sun gear has a central opening for slidably receiving said drive shaft.

5. A table as defined in claim 1, wherein said vertically displaceable means include a lower frame attached to and interconnecting the lower extremities of said posts; said lower frame being vertically displaceable within said base support.

6. A table as defined in claim 1, further comprising an annular member secured to the underface of said top plate, centrally thereof; said drive shaft extending through the center of said annular member; a pin extending cross-wise of said drive shaft and extending into said annular member whereby said drive shaft is supported by said annular member.

* * * * *